US009474430B2

(12) United States Patent
Shoemaker et al.

(10) Patent No.: US 9,474,430 B2
(45) Date of Patent: Oct. 25, 2016

(54) FIXED FULL COVERAGE WASH SYSTEM FOR DISHWASHERS

(71) Applicant: SEARS BRANDS, L.L.C., Hoffman Estates, IL (US)

(72) Inventors: Anthony Daniel Shoemaker, Bartlett, IL (US); Thomas DeSalvo, St. Charles, IL (US); Christopher Salatino, Arlington Heights, IL (US)

(73) Assignee: SEARS BRANDS, L.L.C., Hoffman Estates, IL (US)

( * ) Notice: Subject to any disclaimer, the term of this patent is extended or adjusted under 35 U.S.C. 154(b) by 635 days.

(21) Appl. No.: 13/834,157

(22) Filed: Mar. 15, 2013

(65) Prior Publication Data

US 2014/0261584 A1 Sep. 18, 2014

(51) Int. Cl.
*A47L 15/16* (2006.01)
*A47L 15/42* (2006.01)

(52) U.S. Cl.
CPC ..... *A47L 15/16* (2013.01); *A47L 15/4221* (2013.01); *A47L 15/4282* (2013.01)

(58) Field of Classification Search
None
See application file for complete search history.

(56) References Cited

U.S. PATENT DOCUMENTS 1,730,348 A * 10/1929 Anstiss ..... A47L 15/16 134/172
2,051,233 A * 8/1936 Webb ..... A47L 15/0081 134/165
2,630,813 A * 3/1953 Murdoch ..... A47L 15/16 134/175
2,687,139 A * 8/1954 Noble ..... A47L 15/0055 134/191
2,782,792 A * 2/1957 Robson ..... A47L 15/0081 134/200
2,842,144 A * 7/1958 Lyman ..... A47L 15/16 134/107
3,533,841 A * 10/1970 Radach ..... A47L 15/4204 134/111
4,735,222 A * 4/1988 Crane ..... A47L 15/241 134/172
4,993,444 A * 2/1991 Toriyama ..... A47L 15/18 134/181
5,131,419 A * 7/1992 Roberts ..... A47L 15/0078 134/113
6,053,185 A * 4/2000 Beevers ..... A47L 15/488 134/102.3
6,112,754 A * 9/2000 Bradley ..... A47L 15/20 134/180
6,269,823 B1 * 8/2001 Lincoln ..... B05B 15/061 134/130
2012/0097200 A1 * 4/2012 Fountain ..... A47L 15/22 134/56 D

* cited by examiner

*Primary Examiner* — Michael Barr
*Assistant Examiner* — Cristi Tate-Sims
(74) *Attorney, Agent, or Firm* — McAndrews, Held & Malloy, Ltd.

(57) ABSTRACT

A fixed full coverage wash system that includes a base portion having a generally square or rectangular shaped outer portion that extends into one or more corners of a tub of a dishwasher. The base portion is operably connected to the plurality of arms for the delivery of a pressurized liquid. The base portion may include a plurality of tube segments that are not in fluid communication with at least a portion of the other tube segments. Such an arrangement may be used in connection with a rotor that controls the release, or timing, of pressurized liquid through sprayers in the tube segments. According to certain embodiments, the movement and/or position of the rotor may be controllable, such as, for example, through the use of a controller and motor that allows for the control of the location and/or concentration of where the pressurized liquid is sprayed.

20 Claims, 7 Drawing Sheets

FIXED FULL COVERAGE WASH SYSTEM FOR DISHWASHERS

BACKGROUND OF THE INVENTION

The internal tubs of dishwashers typically have a generally rectangular or square shape. For example, the width of the opening of the tub, where dishes may enter and be removed from the tub through the use of a dishwasher tray, may have the same or different size than the length of the tub from the front to the back of the tub. Further, the front portion and rear sidewall of the tub may be generally perpendicular to the other sidewalls of the tub. However, despite these generally rectangular or square configurations, wash systems typically spray water inside the tub in a circular pattern.

For example, typical dishwasher systems have a rotating spray arm that is propelled by water pressure. When dishes and utensils are being washed in the tub, water pressure propels the spray arm in a circular pattern to spray water and detergent onto as many surfaces of the dishes and utensils as possible. However, as the spray arm moves in a circular pattern, the water delivered by the spray typically cannot reach the corners of the tub, or does not reach the corners, or corner areas, in desired quantities and/or regularity. Thus, dishes placed in the far corners of the tub may receive a smaller amount of water and/or detergent exposure, and therefore may not be washed as well or as thoroughly as dishes and utensils in other areas of the tub that are more adjacent to the spray arm.

Further, as a moving part, the tub should be designed to utilize at least a portion of the space in the tub to accommodate the rotational movement of the spray arm. Moreover, in order for the spray arm to operate, dishes and/or other items in the tub must not be in a position that may interfere with the movement of the spray arm. Thus, the need to dedicate at least a portion of the space in the tub to the movement of the spray arm may reduce the space available for cleaning dishes or other items. Further, such reduction in space may require that taller dishware and other similar tall items be oriented differently in the dishwasher, such as being laid to a side, which may result that dishware occupying additional space in the dishwasher tray so as to reduce the number of other items that may be loaded in the dishwasher tray. Yet, a reduction in the number of items that may be placed in the dishwasher tray may increase overall water and energy usage, as smaller loads of dishes and items being washed may result in an increase in the frequency that the dishwasher is operated.

BRIEF SUMMARY OF THE INVENTION

Certain embodiments of the present technology provide a fixed full coverage wash system for spraying a pressurized liquid into an interior portion of a tub of a dishwasher, the tub having or more corner areas. The system includes a base portion having a plurality of arms and an outer portion. The plurality of arms are configured to deliver the pressurized liquid to the outer portion. The outer portion has a generally square or rectangular shape that extends into approximately one or more corners of the tub. Further, the base portion includes a plurality of sprayers that are configured to spray into the tub at least a portion of the pressurized liquid received from the plurality of arms. At least a portion of the sprayers are configured to spray the pressurized liquid into the one or more corner areas of the tub. Further, according to certain embodiments, the system may also include a rotor, which may be controllable, to control the delivery of pressurized liquid to the plurality of arms and/or the outer portion.

Additionally, certain embodiments of the present technology provide a fixed full coverage wash system for spraying a pressurized liquid into an interior portion of a tub of a dishwasher, the tub having one or more corner areas. The system includes a plurality of arms having an interior passage. The system also includes a plurality of tube segments, each having an inner passage that is not in fluid communication with the inner passage of at least one other of the plurality of tube segments. Further, at least a portion of the plurality of tube segments are configured to extend approximately into a corner of the tub. The plurality of tube segments also include a plurality of sprayers that are in fluid communication with the inner passage. At least a portion of the plurality of sprayers are configured to spray the pressurized liquid into one or more corner areas of the tub.

Certain embodiments of the present technology also provide a fixed full coverage wash system for spraying a pressurized liquid into at least one or more corner areas of an interior portion of a tub of a dishwasher. The system includes a plurality of arms, each of the plurality of arms having an interior passage and a plurality of sprayers. The plurality of sprayers of the arms are in fluid communication with the interior passage and are configured to spray the pressurized liquid into the tub. The system also includes a plurality of tube segments, each having an inner passage that is not in fluid communication with the inner passage of at least one other of the plurality of tube segments. The inner passage of each of the plurality of tube segments is in fluid communication with at least one, but not all, of the interior passages of the plurality of arms. At least a portion of the plurality of tube segments are configured to extend approximately into a corner of the tub. The plurality of tube segments also include a plurality of sprayers that are in fluid communication with the inner passage. At least a portion of the plurality of sprayers of the plurality of tube segments are configured to spray the pressurized liquid into one or more corner areas of the interior portion of the tub. The system also includes a side portion that is configured to receive a pressurized fluid that is delivered by one or more of the plurality of arms. The side portion is also configured to extend along at least a portion of at least one sidewall of the tube. Further, the side portion includes a plurality of sprayers that are configured to spray the pressurized liquid into the interior portion of the tub.

Figure 1:
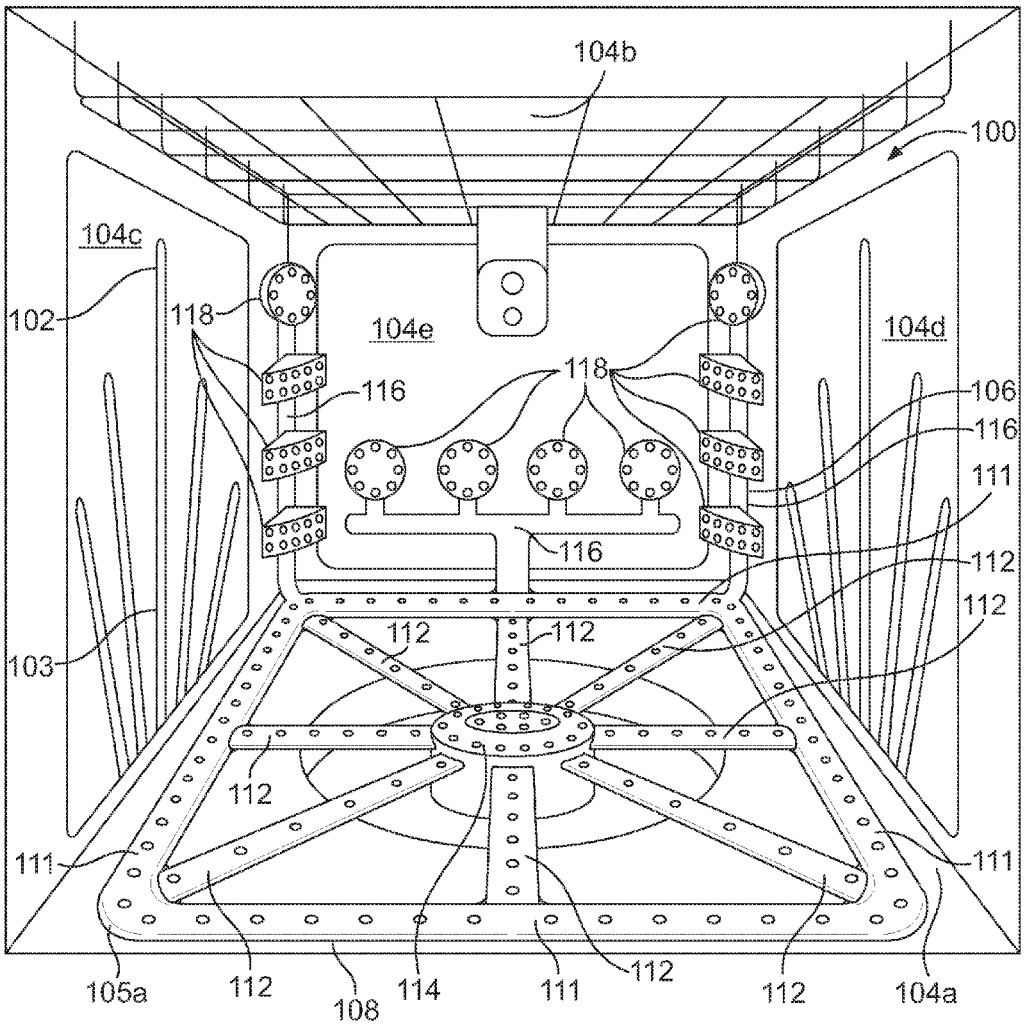
FIG. 1 illustrates a fixed full coverage wash system having a lower base portion that is positioned along a bottom wall of a tub according to certain embodiments of the present invention.

The foregoing summary, as well as the following detailed description of certain embodiments, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

The present invention will now be described more fully with reference to the accompanying drawings, in which several embodiments are shown. This invention may, however, be embodied in many different forms and should not be construed as limited to the embodiments set forth here. Rather, these certain embodiments are examples of the invention, which has the full scope indicated by the language of the claims. Like numbers refer to like elements throughout.

FIG. 1 illustrates a fixed full coverage wash system 100 according to certain embodiments of the present invention. The fixed full coverage wash system 100 is configured to provide a spray system that may be used to spray a liquid, such as, for example, water, detergent, and water containing detergent, among others, onto dishes, utensils, and other items that have been positioned in a tub 102 of a dishwasher. The tub 102 includes an interior portion 103 that may be generally defined by a bottom wall 104*a*, a top wall 104*b*, a first sidewall 104*c*, a second sidewall 104*d*, and a rear wall 104*e*. The tub 102 may also include an open sidewall that opposes the rear sidewall 104*c* and which is used to allow the egress of items into the interior portion 103 of the tub 102, such as, for example, one or more dish trays and/or dishes, among other items. The open sidewall may be closed by a door of the dishwasher.

As shown in FIG. 1, according to certain embodiments, the fixed full coverage wash system 100 may include a lower base portion 105*a* that is positioned along a bottom wall 104*a* of the tub 102. Alternatively, referencing FIG. 2, according to certain embodiments, rather than extending along the bottom wall 104*a*, the fixed full coverage wash system 100 may include an upper base portion 105*b* that extends along a top wall 104*b* of the tub 102. Additionally, referencing FIG. 3, according to certain embodiments, the wash system 100 may include both a lower base portion 105*a* that is positioned along a bottom wall 104*a* of the tub 102, and an upper base portion 105*b* that extends along a top wall 104*b* of the tub 102.

Figure 2:
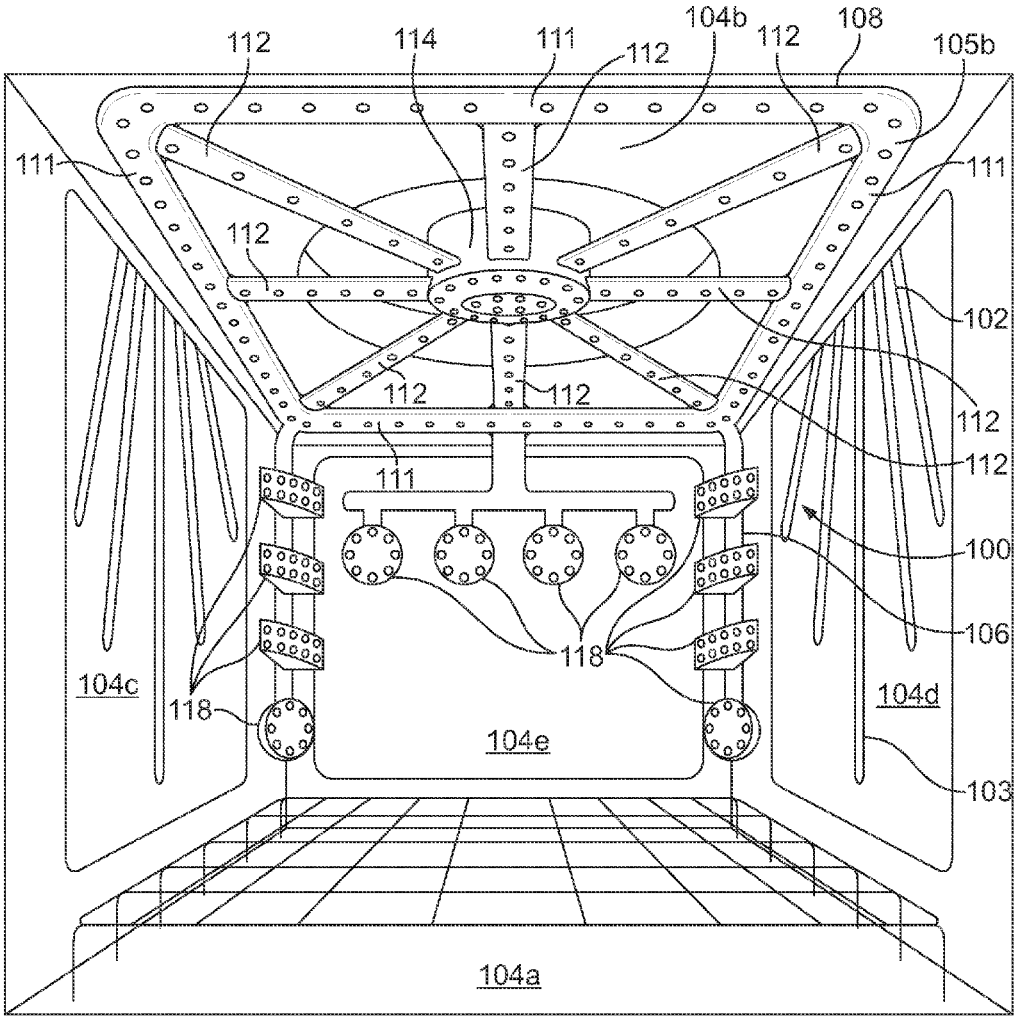
FIG. 2 illustrates a fixed full coverage wash system having an upper base portion that is positioned along an upper wall of a tub according to certain embodiments of the present invention.
Figure 3:
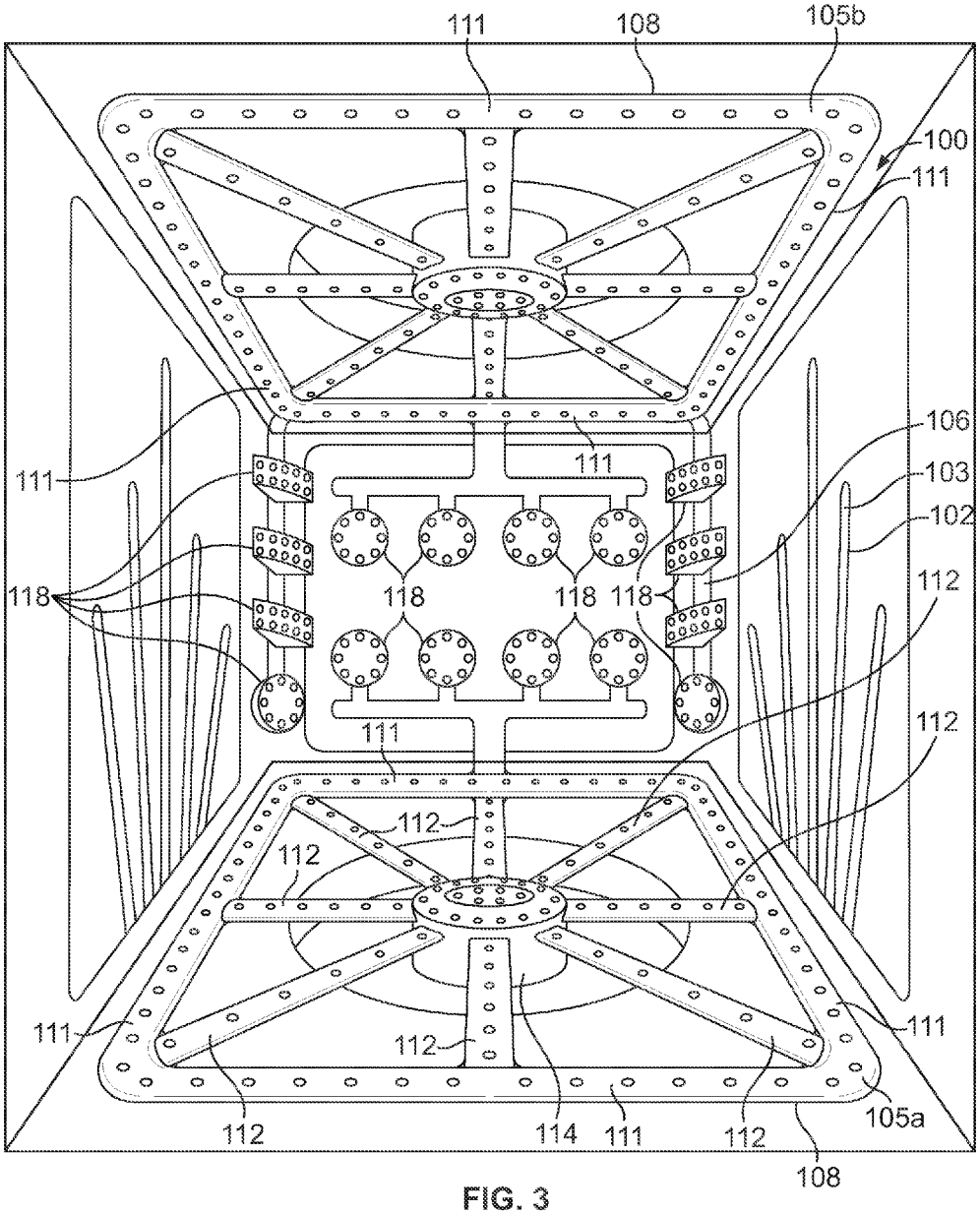
FIG. 3 illustrates a fixed full coverage wash system having both an upper base portion and a lower base portion according to certain embodiments of the present invention.

As illustrated in FIGS. 1-3, according to certain embodiments, the fixed full coverage wash system 100 may also include at least one side portion 106 that extends along at least a portion of at least one sidewall of the tub 102, such as, for example the first, second, and/or rear sidewall(s) 104*c*, 104*d*, 104*e* of the tub 102. As shown, the side portion 106 may have a variety of different shapes and configurations.

As illustrated, according to certain embodiments, the base portion 105*a*, 105*b* may have an outer portion 108 that generally conforms to at least to the shape of the perimeter of the walls 104*a*, 104*b* about which the base portion 105*a*, 105*b* is positioned. For example, referencing FIG. 1, an outer portion 108 of the lower base portion 105*a* has a generally square or rectangular configuration that generally conforms to the shape of the perimeter of the bottom wall 104*a* of the tub 102. In such an arrangement, the outer portion 108 may form a square or rectangular spray head. However, the base portion 105 may take a variety of other shapes besides being generally square or rectangular.

Referencing FIGS. 1-3, according to certain embodiments in which the base portion 108 has a generally rectangular or square shape, the outer portion 108 may have one or more tube segments 111 that either individually or with other tube segments 111 form the outer portion 108. Thus, according to certain embodiments, the outer portion 108 may be a continuous tube that forms and/or is shaped to generally have a desired configuration, such as, for example, a rectangular or square shape, or may require a plurality of tube segments 111 to form a desired shape for the outer portion.

Figure 4:
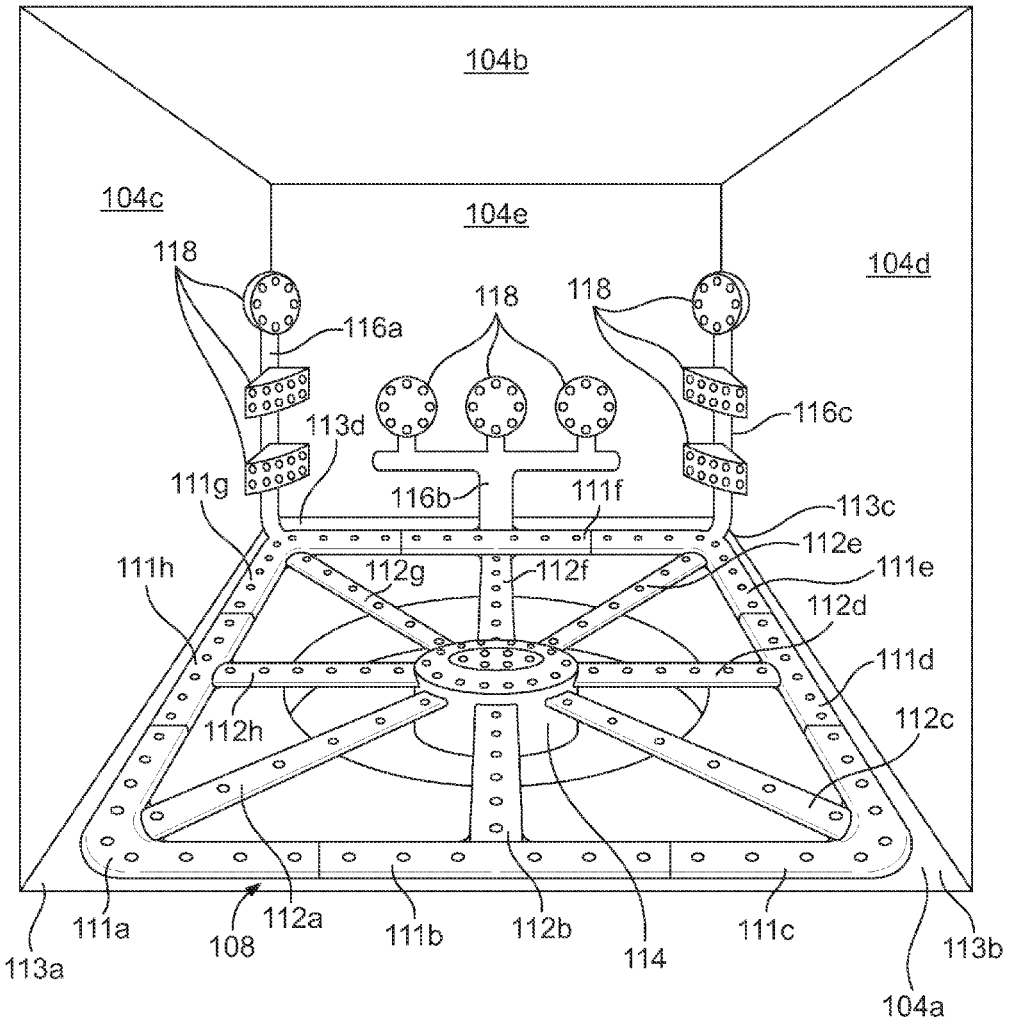
FIG. 4 illustrates fixed full coverage wash system having a lower base portion that is positioned along a bottom wall of a tub according to certain embodiments of the present invention.

According to certain embodiments, each tube segment 111 may extend along at least a portion of at least one wall. For example, as illustrated in FIG. 4, a plurality of tube segments 111*d*, 111*f*, and 111*h* may extend along a portion of the second, rear, and first sidewalls 104*d*, 104*e*, 104*c*, respectively. Additionally, at least some other tube segments may extend along at least a portion of two or more sidewalls, such as, for example, tube segments 111*a*, 111*c*, 111*e*, and 111*g* extending around one or more corners 113*a*, 113*b*, 113*c*, 113*d* of the tub 102. While FIG. 4 illustrates the tube segments 111*a-h* being adjoined in a manner that allows the outer portion 108 to have an enclosed configuration or shape, such as a square or rectangular shape, according to other embodiments, there may be spaces and/or gaps separating at least a portion of the tube segments 111*a-h*, with the tube segments 111*a-h* adjacent to the gap or space having a closed end.

According to certain embodiments, the tube segments 111 may be generally hollow such that a liquid may be pumped through an inner passage of the tube segments 111. However, the inner passage of the tube segments 111 may not be in fluid communication with the inner passage of at least one other tube segment 111. For example, referencing FIG. 4, the inner passage of a tube segment 111*h* along a first sidewall 104*c* may not be in fluid communication with the opposing tube segment 111*d* that is positioned along the second sidewall 104*d*. As discussed below, such lack of fluid communication may, during operation of the associated dishwasher, allow liquid to be sprayed out of some tube segments 111*h* into the tub 102 while liquid is not being sprayed out of other tube segments 111*d*. Such an arrangement may be used to time when liquid is, or is not, to be sprayed into the tub 102 by one or more of the various tube segments 111*a-h*. Further, according to the illustrated embodiment, the outer portion 108 is configured to spray liquid out one or more of the tube segments 111 in an arrangement that allows for the spray of liquid into the corners, or corner areas, of the tub 102.

At least some of, or some portion of, the tube segments 111 may include one or more sprayers 110, through which the liquid is to be sprayed out of the inner passage of the tube segments 111 and into the tub 102, such as, for example, sprayed toward a dish tray, dishware, or other items that have been put into the tub 102 to be cleansed. According to certain embodiments, one or more of the sprayers may be orifices that have been positioned in an outer portion of the tube segments 111 to spray a liquid, such as, for example, pressurized liquid, from the inner passage of the tube segment 111 out at desired direction into the interior portion 103 of the tub 102. According to other embodiments, at least some of the sprayers 110 may be a nozzle that is operably connected to a tube segment 111 and which is in fluid communication with an inner passage of a tube segment 111. Such embodiments may allow for the base portion 105 and side portion 106 to distribute liquid throughout the interior portion 103 of the tub 102 without the use of moving parts.

At least a portion of the liquid flowing through the tube segments 111 may be released through these sprayers 110, while the remaining liquid may continue to flow through the tube segment, 111*a-h*, or onto other tube segments 111, before eventually being released from the tube segment 111 through another of the plurality of sprayers 110. According to certain embodiments, the sprayers 110 may be configured to allow for the release of liquid from the tube segments 111 with sufficient velocity so as to assist in the cleansing of dishes or other items that may be placed in the tub 102. Moreover, a pump may be employed by the system 100 to elevate the pressure of the liquid to an elevated level that facilitates the release of the liquid through the sprayers 110 at a velocity that facilitates the use of the liquid in cleansing and/or washing items in the tub 102.

Liquid may be delivered to the tube segments 111 through arms 112 that are operably connected to the pump. According to certain embodiments, one or more of the arms 112 may extend from an inner sprayer head 114. For example, in the embodiments illustrated in FIGS. 1-4, the arms 112 may extend from the inner sprayer head 114 to tube segments 111 in an arrangement that has an appearance similar to the spokes of a wheel. Additionally, the arms 112 may also include a plurality sprayers 110, which may also be orifices in the arms 112 or nozzles that are operably connected to the arms 112 that are in fluid communication with a fluid containing interior passage of the arms 112. According to certain embodiments, the arms 112 may be configured to distribute the delivery of liquid to the first lower base portion 105*a*, upper base portion 105*b*, and/or the side portion 106.

According to certain embodiments, as discussed below, the arms 112 may be used in the selective distribution of pumped liquid, at certain times, to at least one or more tube segment(s) 111*a-h* that are not in fluid communication with at least one other tube segment 111*a-h*. For example, referencing FIG. 4 in which there are an equal number of arms 112 and tube segment 111, arm 112*a* may deliver liquid to tube segment 111*a*, arm 112*b* may deliver liquid to tube segment 111*b*, arm 112*c* may deliver liquid to tube segment 111*c*, and continue along this pattern through arm 112*h* delivering liquid to tube segment 111*h*. Thus, in embodiments in which liquid is selectively distributed and tube segments 111 are not in fluid communication with each other, liquid may, for example, be delivered to one or more arms 112*c, d, e*, for release from the sprayers 110 of those arms 112*c, d, e* and associated tube segments 111*c, d, e*, while the supply of liquid into other arms 112*a, g, h* may be suspended, thereby preventing or limiting the release of liquid from the sprayers 110 of those arms 112*a, g, h* and associated tube segments 112*a, g, h*. Such control may allow for the release of liquid from the tube segments 111 to be concentrated in a desired area. Further, the supply of liquid to the tube segments 111 through the arms 112 may be timed such that spray patterns may be generated. For example, liquid may be release from one tube segment 111 at a time, sequentially, to create a spray pattern that traverses sequentially across the outer portion 108.

According to certain embodiments, the fixed full coverage wash system 100 may also include at least one side portion 106 that extends along at least a portion of at least one sidewall of the tub 102. The side portion 106 may include one or more secondary arms 116 that may have a variety of different configurations. According to certain embodiments, the secondary arms 116 may extend from, and be in fluid communication with, an adjacent portion of a tube segment 111. For example, referencing FIG. 4, according to such embodiments, the arm 112*g* used to deliver liquid to a tube segment 111*g* may also be delivering liquid that passes into an interior passage of the associated secondary arm 116*a*. The secondary arms 116 may also include orifices that provide sprayers 110 used to spray the liquid used in cleansing items placed in the tub 102. Further, according to certain embodiments, rather than having a plurality of sprayers 110, at least a portion of the secondary arms 116 may be operably connected to one or more secondary spray heads 118. As shown, in such an embodiment, the secondary spray heads 118 may have a variety of different configurations, such as non-round, rectangular, circular, oval, square, and trapezoidal, among others. Additionally, each secondary spray head 118 may have a plurality of sprayers 110 in the same, or in a variety, of different configurations.

The embodiments shown in FIGS. 1-4 provide certain benefits. For example, the relatively square or rectangular shape of the base portion 105 allows the spray system to generally follow the perimeter of the adjacent sidewall, such as, for example, the bottom or top wall 104*a*, 104*b*, so that the base portion 105 may extend into at least some of the corners 113*a-d* of the tub 102. Moreover, by extending into the corners 113*a-d*, liquid released through at least some of the sprayers 110 may reach into the farthest corners 113*a-d*, or corner areas, of the tub 102 for better liquid coverage, and therefore better cleaning performance. Moreover, such a configuration may translate into the placement of sprayers 110 to cover a relatively larger area for more cleaning ability than traditionally achieved with rotating spray arms. Additionally, according to certain embodiments, the base portion 105 and second portion 106 may not have moving parts, which may prevent service incidents experienced by dishwashers that have rotating arms and the potential for the contents inside the tub 102, such as dishware, to block the movement of the spray arm, which is detrimental to cleaning performance. Moreover, by not having moving parts like a rotating spray arm, the fixed full coverage wash system 100 may allow for lower clearances between the fixed full coverage wash system 100 and the dish racks, or the items contained therein, such as dishware. This lower clearance may allow for larger loads of dishes to be loaded into the tub 102, which may create a lower overall liquid and energy usage.

Figure 5:
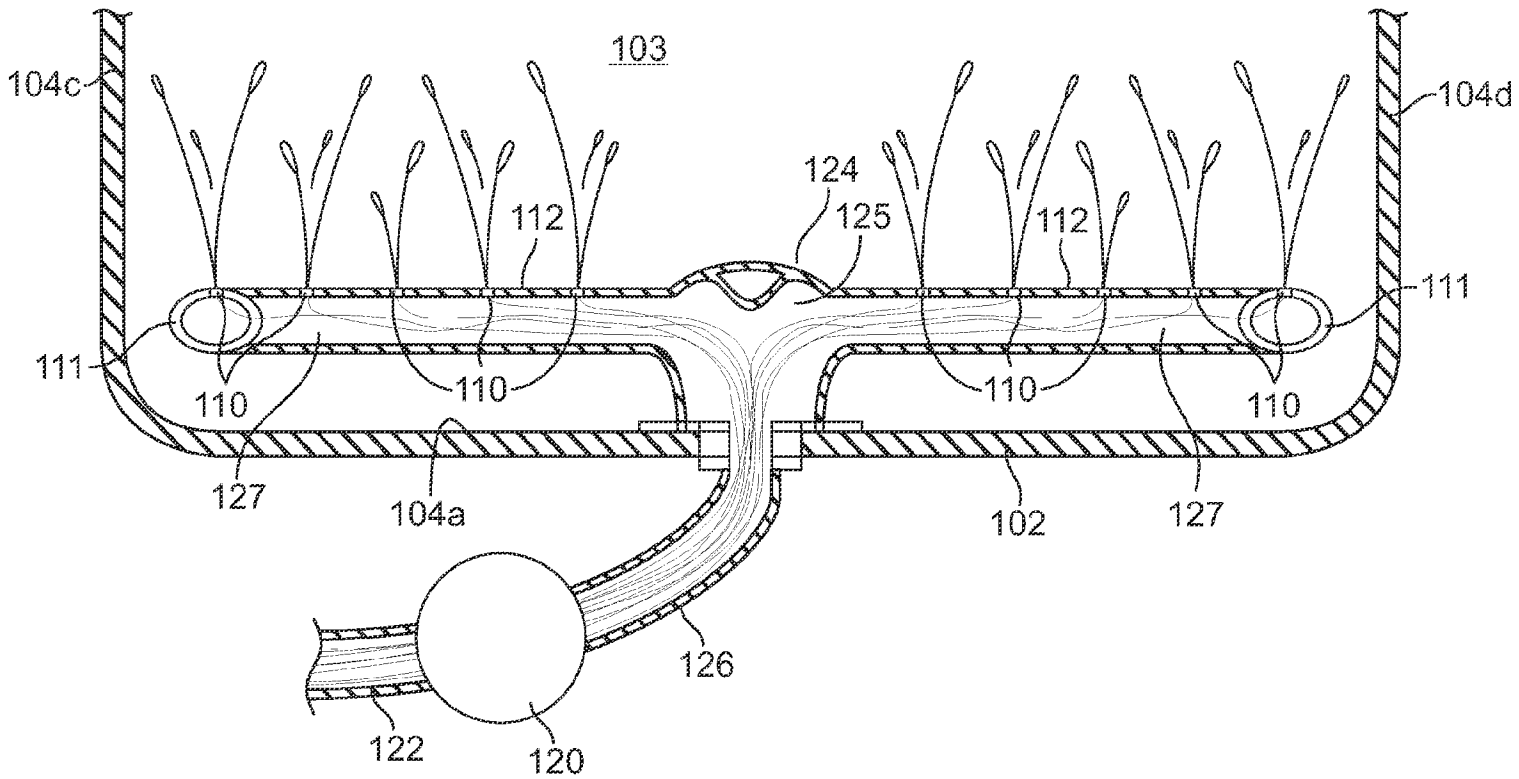
FIG. 5 illustrates the delivery and disbursement of pressurized liquid into the arms of a fixed full coverage wash system according to certain embodiments of the present invention.

Referencing FIG. 5, the fixed full coverage wash system 100 includes an internal pump 120 in the dishwasher that elevates the pressure of liquid that is delivered to the arms 112, tube segments 111, and secondary arms 116. The pump 120 may receive a liquid, such as water, via a supply line 122, which may, for example, be operably connected to a water source or associated plumbing. As shown in FIG. 5, according to embodiments, after the pressure of the liquid is elevated by the pump 120, the liquid may be delivered to an interior portion 125 of a hub 124 via an outlet line 126. According to certain embodiments, the hub 124 may extend into interior portion 103 of the tub 102. According to certain embodiments, the interior portion 125 of the hub 124 may include a diffuser 127 that is used to at least assist in directing and/or deflecting the liquid pumped into the interior portion 125 to the interior passage 127 into one or more arms 112. As shown, at least a portion of the pressurized liquid may be released from the interior passage 127 of the arm 112 through sprayers 110, while the remaining liquid is delivered to the inner passage 129 of the tube segments 111.

Figure 6:
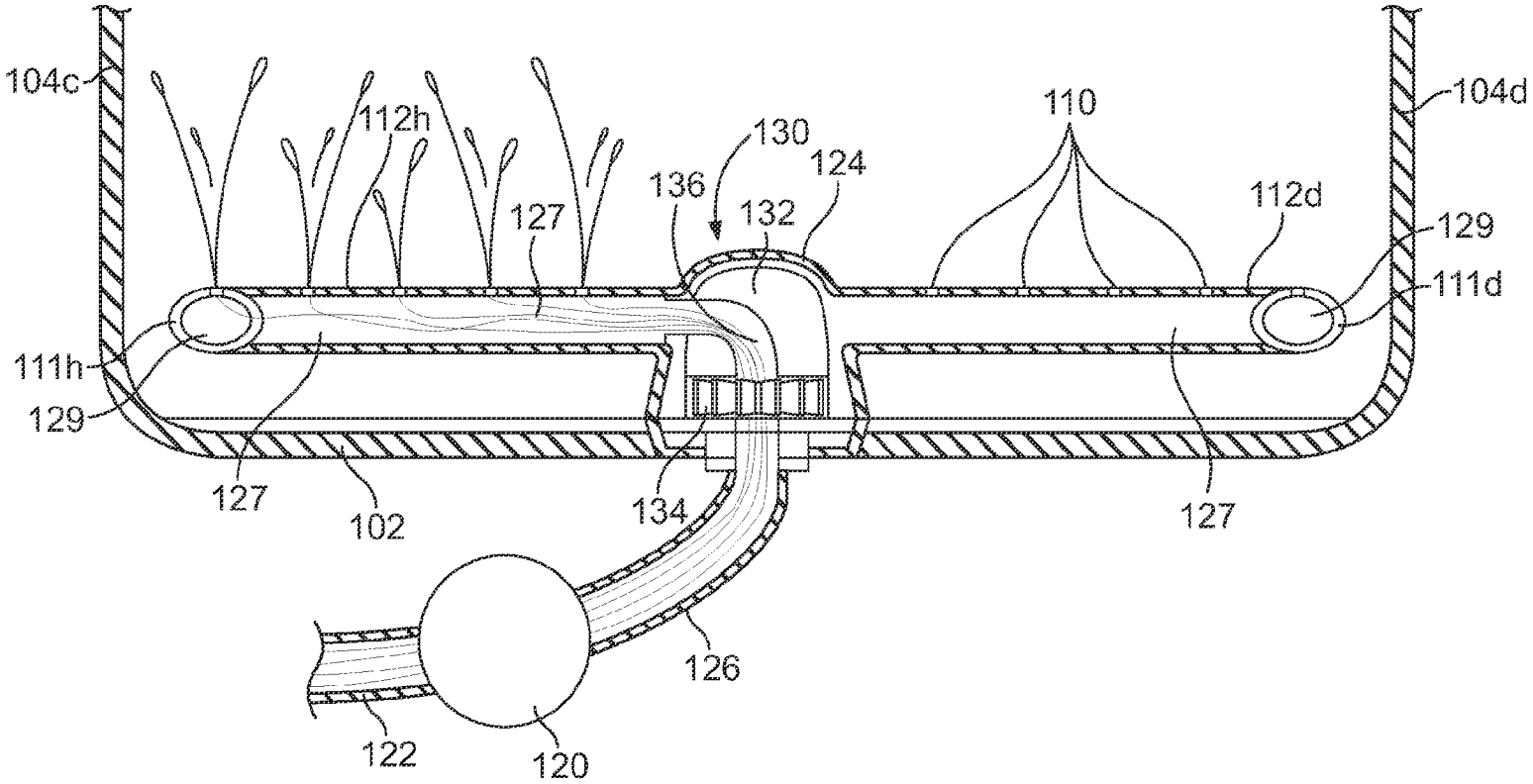
FIG. 6 illustrates the use of a rotor to control the delivery of pressurized liquid into the arms and tube segments of a fixed full coverage wash system according to certain embodiments of the present invention.

FIG. 6 illustrates an embodiment in which a rotating valve 130 is used to alter the delivery of the pressurized liquid into the arms 112, and associated tube segments 111. According to such embodiments, at least a portion of the arms 112 and associated tube segments 111 may not be in fluid communication with at least a portion of the other arms 112 and associated tube segments 111. The rotating valve 130, which may be housed in the interior portion 125 of the hub 124, may include a rotor 132 and a rotation mechanism 134. A variety of different rotation mechanisms 134 may be employed, including, for example, a liquid turbine, liquid jet, or liquid driven mechanically rotated device, among others.

Operation of the rotor 132 may result in the rotational movement of the rotor 132 within the hub 124. The rotor 132 may include one or more passageways 136 through which the pressurized liquid may flow. The flow of the pressurized liquid may cause at least a portion of the rotation mechanism 134 to rotate or spin, which is translated into rotational movement of the rotor 132. The liquid then passes into the passageway 136 of the rotor 132. The outlet of the passageway 136 then delivers the pressurized liquid to an arm 112*a-h*. However, which one(s), or when, the arm 112*a-h* receives the pressurized liquid may depend on the rotational position of the rotor 132, and more specifically, which interior passage 127 of the arms 112 is aligned with passageway 136 of the rotor 132.

For example, as illustrated in FIG. 6, the passageway 136 is shown to as currently being aligned with the interior passage 127 of arm 112*h*, which is in fluid communication with tube segment 111*h*. Such alignment allows pressurized liquid to be sprayed from the sprayers 110 of arm 111*h* and tube segment 111*h*. However, as the passageway 136 of the rotor 132 is not aligned with the interior passage 127 of arm 112*d*, liquid is not being delivered to arm 112*d* or associated tube segment 111*d*. Therefore, at the illustrated position of the rotor 132, liquid is not being released through the sprayers 110 of arm 112*d* and tube segment 111*d*. However, as the movement of the rotation mechanism 134 results in the rotational movement of the rotor 132, the passageway 136 may be moved from being aligned with the interior passage 127*h* of arm 112*h* to being aligned with the interior passage 127 of another arm(s) 112 before eventually being rotated into alignment with the interior passage 127 of arm 112*d*. Such rotational movement of the passageway 136 may result in a sequential spray pattern by the system 100. While FIG. 6 illustrates the rotor 132 as having one passageway 136, according to certain embodiments, the rotor 132 may include a plurality of passageways 136.

Figure 7:
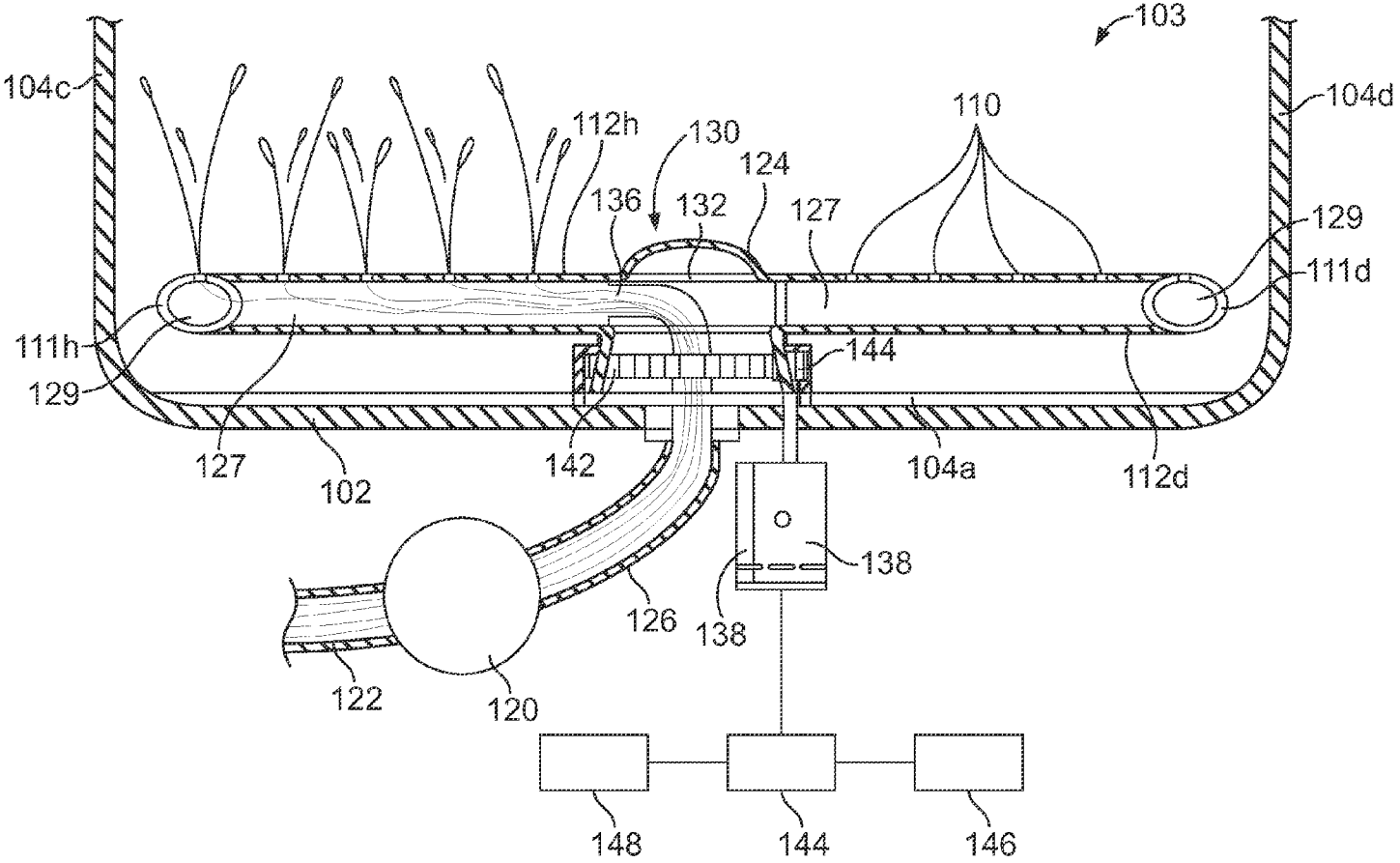
FIG. 7 illustrates a controllable rotor to control the delivery of pressurized liquid into the arms and tube segments of a fixed full coverage wash system according to certain embodiments of the present invention.

Which and/or when, a particular arms(s) 112 and/or tube segment(s) 111 receives the pressurized liquid may also be controllable by the user or an electronic controller 144. For example, referencing FIG. 7, the rotational movement of the rotor 132 may be electronically controlled, such as, for example, by a motor, including a stepper motor 138, among others. The stepper motor 138 may receive signals from an electronic controller 144 or processor that indicates or reflects which direction the rotor 132 is to move and/or the desired degree of movement of the rotor 138. According to certain embodiments, the stepper motor 138 may drive a first gear 140 that mates with a second gear 142 that is on or operably connected to, the rotor 132. The rotational movement of the first gear 140 may result in the rotational movement of the second gear 142, and thus the rotational movement of the rotor 132 and associate passageway 136. However, besides the use of one or more gears 140, 142, the rotor 132 may be rotated in a number of different ways, including, for example, through the use of a belt or pulley that is driven by the stepper motor 138.

The controller 144 used to operate the stepper motor 138 may be operably connected to an input 148 that is operated by a user, such as a control panel or touch screen on the dishwasher. Further, the controller 144 may also be in communication with, or include, a memory 146 that may store various instructions for the operation of the stepper motor 138, which may provide, for example, various wash patterns, cycles, and/or other programmable features. According to certain embodiments, wash cycles may be pre-programmable and/or allow for customized user-programmable cycles.

By varying and/or controlling the position of the rotor 132, the performance or characteristics of the liquid sprayed into the tub 102 by the system 100 may be controlled. For example, according to certain embodiments, the spraying of liquid by the arms 112, 116 and/or tube segments 111 may be cycled between on and off conditions, such that liquid may repeatedly start and stop striking dishware and other items in the tub 102. Further, such control may allow for variations in the intensity or speed at which liquid is released from the system 100. Such controllable features may also allow for the system 100 to provide unique programmable wash cycles, such as, for example, the simulation of scrubbing, that may further assisting in removal of soil from the dishware and other items in the tub 102. Further, the control or variation in location of where the first and/or second portions 105*a*, 105*b*, 106 spray liquid into the interior portion 103 of the tub 102 may be used to recreate a rotational spray pattern.

The controllable nature of the rotor 132 may also allow the user to select and direct what area of the tub 102 they desire liquid to be directed. This feature may allow the user to do smaller loads if necessary, and to direct and/or concentrate the delivery of liquid from the system 100 to the particular area of the tub 102 in which the items to be washed are located. Such control of the direction, concentration, and/or pattern of liquid being released from the system 100 and into the tub 102 may, at least in some instances, result in less liquid and energy usage, while still maintaining a relatively high level of wash performance.

The invention claimed is:

1. A fixed full coverage wash system for spraying a pressurized liquid into an interior portion of a tub of a dishwasher, the tub having or more corner areas, the system comprising:

a base portion having a plurality of arms and an outer portion, the plurality of arms extending radially from an inner sprayer head and being operably connected to a pump and configured to deliver the pressurized liquid to the outer portion, the outer portion having four sides forming a generally square or rectangular shape that extends into approximately one or more corners of the tub, each of the four sides of the outer portion having a plurality of sprayers configured to spray into the tub at least a portion of the pressurized liquid received from the plurality of arms, at least a portion of the sprayers configured to spray the pressurized liquid into the one or more corner areas of the tub.

2. The fixed full coverage wash system of claim 1, wherein the base portion is positioned along a bottom wall of the tub.

3. The fixed full coverage wash system of claim 1, wherein the base portion is positioned along a top wall of the tub.

4. The fixed full coverage wash system of claim 1, wherein the base portion includes a lower base portion that is positioned along a bottom wall of the tub and an upper base portion that is positioned along the top wall of the tub.

5. The fixed full coverage wash system of claim 1, further including a side portion configured to receive a pressurized fluid delivered by one or more of the plurality of arms, the side portion having a secondary arm configured to extend along at least a portion of at least one sidewall of the tub, the side portion including a plurality of sprayers configured to spray the pressurized liquid into the interior portion of the tub.

6. The fixed full coverage wash system of claim 5, wherein the plurality of sprayers of the side portion are positioned on one or more secondary spray heads that extend from the secondary arm.

7. The fixed full coverage wash system of claim 1, wherein the outer portion comprises a plurality of tube segments, at least a portion of the plurality of tube segments not being in fluid communication with others of the plurality of tube segments.

8. The fixed full coverage wash system of claim 7, in which the base portion does not include moveable parts.

9. The fixed full coverage wash system of claim 7, further including a rotor having a passageway configured for the passage of the pressurized fluid, the rotor being configured for rotational movement about a hub, the rotational movement of the rotor configured to alter which of the plurality of arms is in fluid communication with the passageway of the rotor.

10. The fixed full coverage system of claim 9, further including a controller and a motor, the motor being operably connected to the rotor, the controller configure to provide instructions to operate the motor to rotate the rotor.

11. A fixed full coverage wash system for spraying a pressurized liquid into an interior portion of a tub of a dishwasher, the tub having a central interior portion and an outer interior portion having one or more corners, the system comprising:

a plurality of arms operably connected to a pump, each of the plurality of arms having an interior passage, each of the plurality of arms configured to deliver the pressurized liquid from the central interior portion through the interior passage to at least one of a plurality of tube segments at the outer interior portion; and the plurality of tube segments, the plurality of tube segments each having an inner passage that is not in fluid communication with the inner passage of at least one other of the plurality of tube segments, at least a portion of the plurality of tube segments configured to extend approximately into one or more of the corners of the tub, the plurality of tube segments also having a plurality of sprayers in fluid communication with the inner passage, at least a portion of the plurality of sprayers configured to spray the pressurized liquid into one or more corner areas of the tub.

12. The fixed full coverage wash system of claim 11, wherein the plurality of tube segments are joined together to form a generally rectangular or square configuration.

13. The fixed full coverage wash system of claim 12, further including a side portion configured to receive a pressurized fluid delivered by the one or more of the plurality of arms, the side portion having a secondary arm configured to extend along at least a portion of at least one sidewall of the tub, the side portion including a plurality of sprayers configured to spray the pressurized liquid into the interior portion of the tub.

14. The fixed full coverage wash system of claim 13, wherein the plurality of sprayers of the side portion are positioned on one or more secondary spray heads that extend from the secondary arm.

15. The fixed full coverage wash system of claim 11, further including a rotor having a passageway configured for the passage of the pressurized fluid, the rotor being configured for rotational movement about a hub, the rotational movement of the rotor configured to alter which of the plurality of arms is in fluid communication with the passageway of the rotor.

16. The fixed full coverage system of claim 15, further including a controller and a motor, the motor being operably connected to the rotor, the controller configure to provide instructions to operate the motor to rotate the rotor.

17. A fixed full coverage wash system for spraying a pressurized liquid into at least one or more corner areas of an interior portion of a tub of a dishwasher, the system comprising:

a plurality of arms extending radially from a hub, each of the plurality of arms having an interior passage and a plurality of sprayers, the plurality of sprayers being in fluid communication with the interior passage and configured to spray the pressurized liquid into the interior portion;

a plurality of tube segments, the plurality of tube segments each having an inner passage that is not in fluid communication with the inner passage of at least one other of the plurality of tube segments, the inner passage of each of the plurality of tube segments being in fluid communication with at least one, but not all, of the interior passages of the plurality of arms, at least a portion of the plurality of tube segments configured to extend approximately into a corner of the tub, the plurality of tube segments also including a plurality of sprayers being in fluid communication with the inner passage, at least a portion of the plurality of sprayers of the plurality of tube segments configured to spray the pressurized liquid into one or more corner areas of the interior portion of the tub; and a side portion configured to receive a pressurized fluid delivered by one or more of the plurality of arms, the side portion configured to extend along at least a portion of at least one sidewall of the tub, the side portion including a plurality of sprayers configured to spray the pressurized liquid into the interior portion of the tub.

18. The fixed full coverage wash system of claim 17, wherein the plurality of tube segments are joined together to form a generally rectangular or square configuration.

19. The fixed full coverage wash system of claim 18, further including a rotor having a passageway configured for the passage of the pressurized fluid, the rotor being configured for rotational movement about the hub, the rotational movement of the rotor configured to alter which of the plurality of arms is in fluid communication with the passageway of the rotor.

20. The fixed full coverage system of claim 19, further including a controller and a motor, the motor being operably connected to the rotor, the controller configure to provide instructions to operate the motor to rotate the rotor.

* * * * *